US010090095B2

(12) United States Patent
Lu et al.

(10) Patent No.: US 10,090,095 B2
(45) Date of Patent: Oct. 2, 2018

(54) STATIONARY INDUCTION ELECTRICAL APPARATUS

(71) Applicant: HITACHI, LTD., Tokyo (JP)

(72) Inventors: Li Lu, Tokyo (JP); Kenichi Kawamura, Tokyo (JP); Hiroshi Miyao, Tokyo (JP); Hiroshi Morita, Tokyo (JP); Satoshi Ichimura, Tokyo (JP); Jun Nukaga, Tokyo (JP); Shinji Fujita, Tokyo (JP); Kohei Yamaguchi, Tokyo (JP); Hideki Ogata, Tokyo (JP); Masato Suzuki, Tokyo (JP)

(73) Assignee: HITACHI, LTD., Tokyo (JP)

( * ) Notice: Subject to any disclaimer, the term of this patent is extended or adjusted under 35 U.S.C. 154(b) by 0 days.

(21) Appl. No.: 15/485,855

(22) Filed: Apr. 12, 2017

(65) Prior Publication Data

US 2017/0301454 A1 Oct. 19, 2017

(30) Foreign Application Priority Data

Apr. 13, 2016 (JP) ..... 2016-079973

(51) Int. Cl.

| | |
|---|---|
| ***H01F 27/06*** | (2006.01) |
| ***H01F 27/12*** | (2006.01) |
| ***H01F 21/12*** | (2006.01) |
| ***H01F 27/28*** | (2006.01) |
| ***H01F 27/32*** | (2006.01) |

(52) U.S. Cl.

CPC ..... *H01F 27/289* (2013.01); *H01F 27/2823* (2013.01); *H01F 27/2871* (2013.01); *H01F 27/2876* (2013.01); *H01F 27/323* (2013.01)

(58) Field of Classification Search

USPC ..... 336/60, 57, 137, 189, 222, 231, 69

See application file for complete search history.

(56) References Cited

U.S. PATENT DOCUMENTS 3,348,182 A * 10/1967 Baker ..... H01F 27/2871 336/187
3,710,292 A * 1/1973 Van Nice ..... H01F 27/343 336/60
4,000,482 A * 12/1976 Staub ..... H01F 27/322 336/60
4,017,815 A * 4/1977 Sauer ..... H01F 27/343 336/70

(Continued)

FOREIGN PATENT DOCUMENTS

JP 2001-196237 A 7/2001

*Primary Examiner* — Elvin G Enad
*Assistant Examiner* — Kazi Hossain
(74) *Attorney, Agent, or Firm* — Volpe and Koenig, P.C.

(57) ABSTRACT

A stationary induction electrical apparatus includes a disc winding having a structure in which a flow path for a cooling medium is provided between coils where a low voltage is generated between shield wires, an L-shaped insulation barrier is provided between coils where a high voltage is generated between the shield wires, a horizontal portion of the L-shaped insulation barrier is provided so as to closely contact an upper surface or a lower surface of the disc coil, a tip end portion in an axial direction of the L-shaped insulation barrier is provided so as to closely contact an inner surface of the disc coil which is adjacent to a press-board insulation cylinder, and a height of the tip end portion in the axial direction is lower than a thickness of one coil.

1 Claim, 4 Drawing Sheets

(56) References Cited

U.S. PATENT DOCUMENTS

| | | | | | |
|---|---|---|---|---|---|
| 4,317,096 | A * | 2/1982 | Degeneff | ..... | H01F 27/006<br>336/70 |
| 4,318,066 | A * | 3/1982 | Degeneff | ..... | H01F 27/362<br>336/187 |
| 5,167,063 | A * | 12/1992 | Hulsink | ..... | H01F 27/322<br>242/445 |
| 2016/0268037 | A1 * | 9/2016 | Nishimizu | ..... | H01F 27/2871 |

* cited by examiner

STATIONARY INDUCTION ELECTRICAL APPARATUS

BACKGROUND OF THE INVENTION

1. Field of the Invention

The present invention relates to a stationary induction electrical apparatus including a disc winding such as a transformer and a reactor, and particularly relates to a stationary induction electrical apparatus including a disc winding in which a shield wire for shielding lightning surge is wound.

2. Description of Related Art

The disc winding having a high mechanical strength is widely used as a winding for a core-type stationary induction electrical apparatus from the past. The disc winding has a disadvantage that a series capacitance between coils is small and characteristics for an impulse voltage such as a lightning surge are not good as the disc winding is formed by stacking disc coils with a small number of turns and a relatively small facing area. In response to this, a CC shield wire which is electrostatically coupled and adds the series capacitance between coils by the shield wire not allowing a load current to flow in distant coils has been invented, which is used for a high-voltage winding of the transformer and so on.

In the structure of a disc winding using the CC shield wire described in JP-A-2001-196237 (hereinafter referred to as Patent Document 1), the series capacitance between coils is increased and potential distribution characteristics with respect to the impulse voltage such as the lightning surge and so on are improved. However, when the impulse voltage intrudes from a line end, a large voltage is generated between disc coils of even ordinal numbers counted from the line end and it is difficult to achieve insulation in the above structure.

As a common method for preventing dielectric breakdown due to the high voltage generated between the disc winding coils using the shield wire, a method of increasing a thickness of an inter-coil spacer to increase an insulation distance or a method of increasing a thickness of the shield wire to reduce an electric field can be cited. However, a winding space factor in a staking direction of the disc winding is not increased as the inter-coil spacer is increased in the former method. In the latter method, a winding space factor in a circumferential direction of the disc winding is not increased as the thick shield wire is arranged. In order to solve these problems, there is a method described in Patent Document 1, in which a space is provided between the shield wire and an insulating film at an end portion of the shield wire and an insulation material is arranged in the space. There are problems the winding space factor is not increased and manufacturing processes are complicated.

SUMMARY OF THE INVENTION

In a stationary induction electrical apparatus including a disc winding in which plural disc coils provided with a plurality of electric wires wound in a helical manner on the same plane in a circumferential direction are stacked in an axial direction of a pressboard insulation cylinder, coils in which an inter-coil spacer is arranged between the disc coils are provided, an inner-peripheral side crossover line connecting between inner-peripheral side wires arranged on both sides of the inter-coil spacer, an outer peripheral side wire connecting to inner-peripheral side crossover line, a shield wire of a certain-ordinal layer in the axial direction and shield wires of the fourth, sixth . . . layers counted from the shield wire among shield wires wound with plural turns between wires of respective disc coils are connected by a crossover line for shielding, and a high voltage and a low voltage are alternately generated between adjacent shield wires arranged in the axial direction, the apparatus includes a flow path for a cooling medium provided between coils where a low voltage is generated between shield wires and an L-shaped insulation barrier provided between coils where a high voltage is generated between the shield wires, in which a horizontal portion of the L-shaped insulation barrier is provided so as to closely contact an upper surface or a lower surface of the disc coil, a tip end portion in an axial direction of the L-shaped insulation barrier is provided so as to closely contact an inner surface of the disc coil which is adjacent to the pressboard insulation cylinder, and a height of the tip end portion in the axial direction is lower than a thickness of one coil.

According to the invention, the dielectric breakdown due to the high voltage generated between disc coils can be prevented by providing a barrier to increase a withstand voltage as compared with a case where the barrier is not provided without increasing a winding space factor of the disc winding and without complicating manufacturing processes.

DESCRIPTION OF EMBODIMENTS

Hereinafter, a winding configuration diagram according to the invention will be explained based on shown embodiments. The same symbols are used for the same components in respective embodiments.

Embodiment 1

Figure 1:
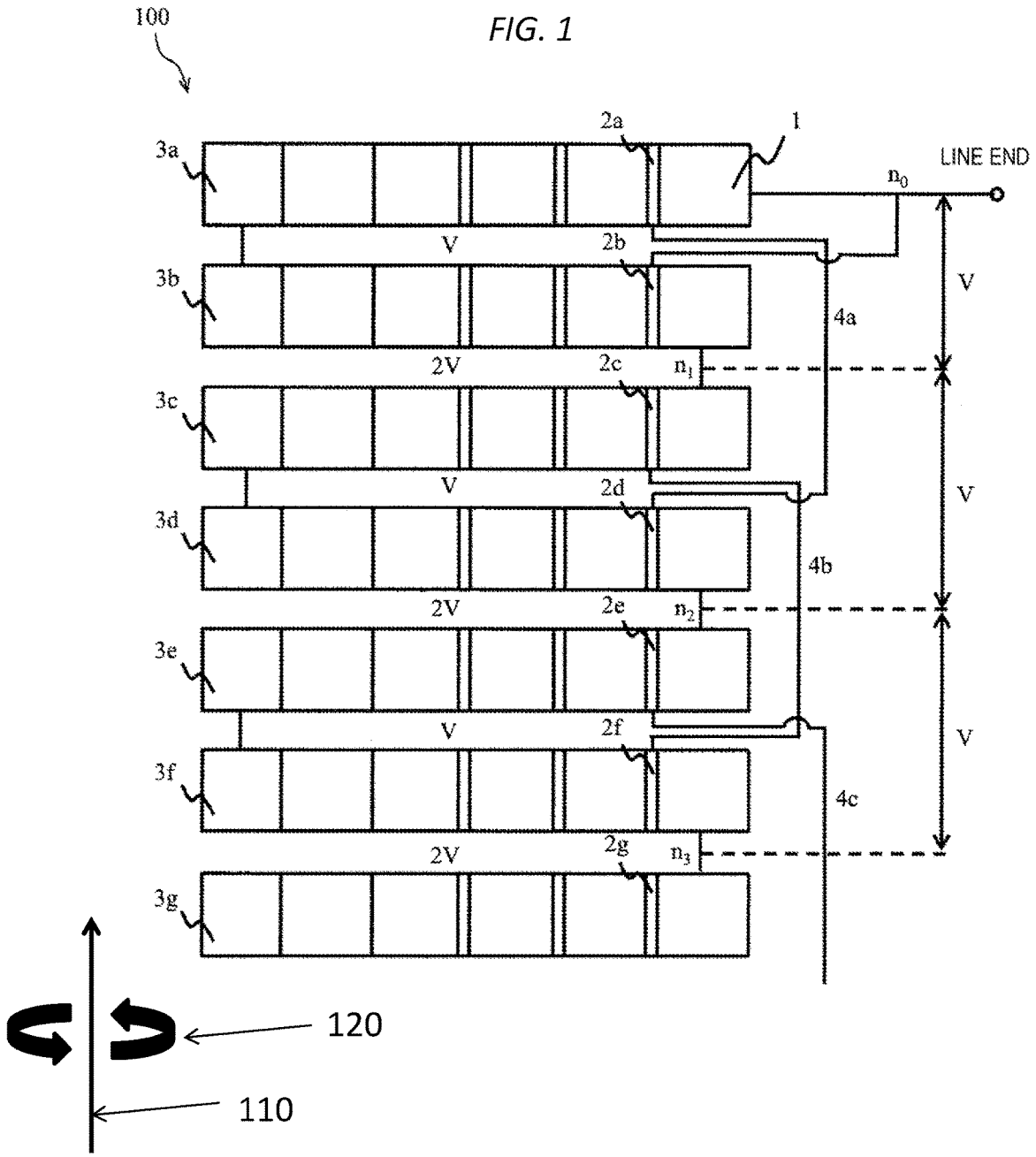
FIG. 1 is a vertical cross-sectional view of a disc winding connection of a stationary induction electrical apparatus according to Embodiment 1 of the invention.

FIG. 1 shows a vertical cross-sectional view of a disc winding connection diagram of a stationary induction electrical apparatus according to Embodiment 1 of the invention.

As shown in the drawing, in a disc winding 100 according to the embodiment, 1 denotes an electric wire in which a load current flows and 2*a* denotes a shield wire in which the load current does not flow. The winding having a structure in which plural disc coils 3*a*, 3*b*, 3*c* . . . in which the electric wire 1 is wound in a circumferential direction 120 with 6 turns and the shield wire 2*a* is wound with 3 turns on the outer peripheral side thereof are stacked in an axial direction 110. Here, the electric wire 1 is wound without being connected. A shield wire 2*b* wound in the disc coil 3*b* of an even-ordinal layer is connected to a line end. The shield wire 2*a* is connected to a shield wire 2*d* of the fourth layer counted from the shield wire 2*a* by a crossover line 4*a* for shielding, which is in an electrically floating potential.

In the above structure, the series capacitance between coils is increased and potential distribution characteristics with respect to an impulse voltage such as a lightning surge are improved. However, in such wire connection, a large voltage is generated between the shield wire 2*b* wound in the disc coil 3*b* of the even-ordinal number counted from the line end and the shield wire 2*c* wound in the disc coil 3*c* and it is difficult to achieve insulation when the impulse voltage intrudes from the line end.

In FIG. 1, when voltages generated between respective nodes $n_0$, $n_1$, $n_2$, . . . at the time of applying the impulse voltage from the line end are assumed to be V for simplification, potentials of crossover lines for shielding 4*a*, 4*b*, 4*c*, . . . are approximately equal to potentials of the $n_1$, $n_2$, $n_3$, . . . according to geometric arrangement thereof, therefore, a voltage V and a voltage 2V are alternately generated between the shield wires 2*a* and 2*b* and between the shield wires 2*b* and 2*c* wound in the disc coils 3*a*, 3*b* and 3*c*.

Figure 2:
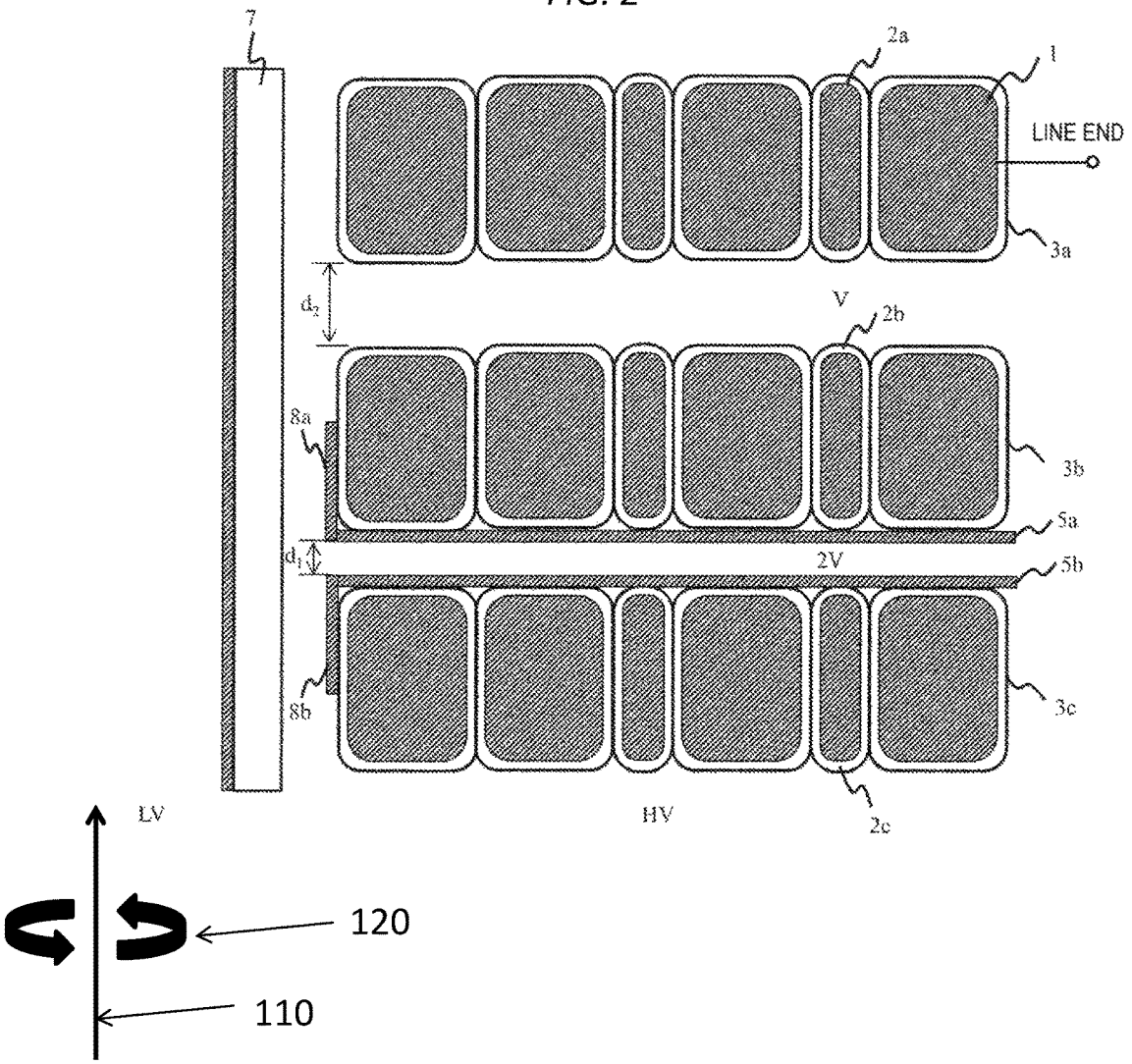
FIG. 2 is a partially enlarged vertical cross-sectional view for explaining a structure of a disc winding according to Embodiment 1 of the invention.

In order to prevent dielectric breakdown due to the high voltage 2V, an L-shaped insulation barrier 5*a* is provided so as to closely contact the entire lower surface of a disc coil of an even-ordinal layer, for example, the disc coil 3*b* as shown in FIG. 2. Also, an L-shaped insulation barrier 5*b* is provided on the entire upper surface of a disc coil of an odd-ordinal layer, for example, the disc coil 3*c*. The L-shaped insulation barriers 5*a* and 5*b* may have the same material and the size.

Figure 3:
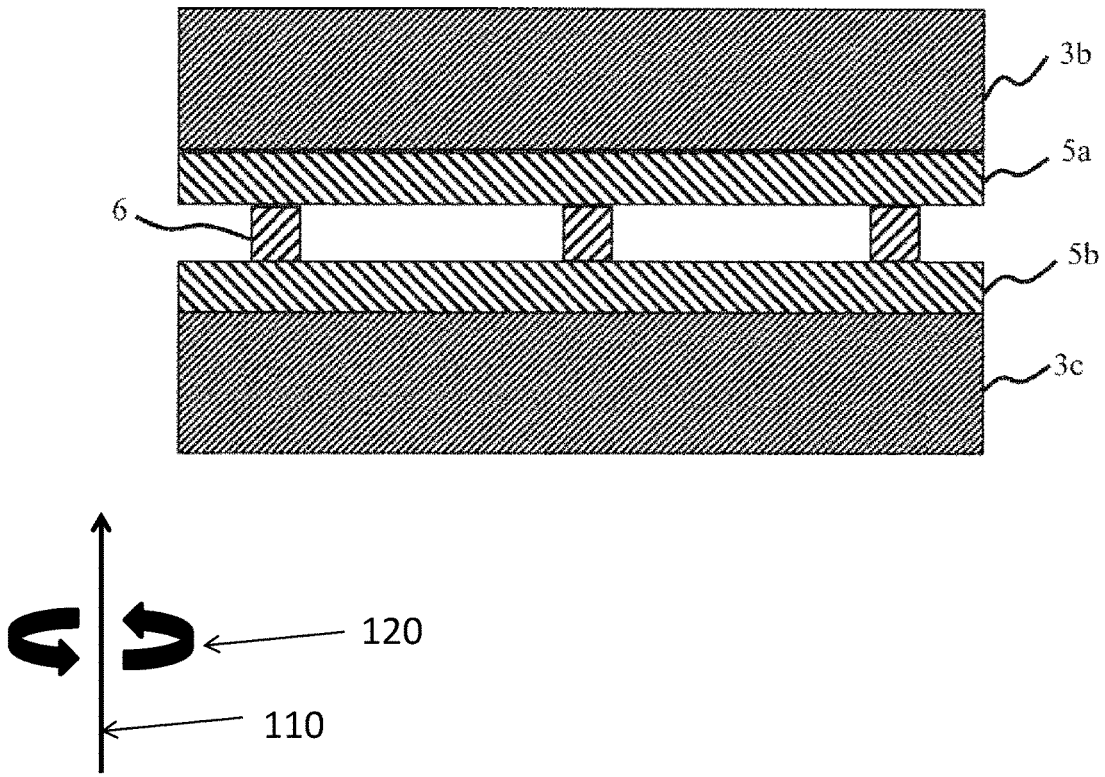
FIG. 3 is an explanatory view for explaining a method of providing a barrier according to Embodiment 1 of the invention.

Generally, inter-coil spacers 6 are arranged between disc coils at intervals to provide flow paths through which a cooling medium flows between coils. Accordingly, the L-shaped insulation barrier 5*a* is provided between the disc coil 3*b* and the inter-coil spacers 6 as shown in FIG. 3. The L-shaped insulation barrier 5*a* may be thick enough not to be bent and not to be broken down when the voltage of 2V is applied.

Similarly, the L-shaped insulation barrier 5*b* is provided between the coil 3*c* and the inter-coil spacers 6.

As a material for the L-shaped insulation barriers 5*a* and 5*b*, a hard and high insulation solid material with high oil resistance is preferable to be used. For example, a press board, resin and so on can be used.

The above disc winding is generally used as a high-voltage (HV) winding for a large transformer. A pressboard insulation cylinder 7 is formed between the HV winding and a low-voltage (LV) winding.

Due to the high voltage between the shield wires 2*b* and 2*c*, the streamer which is a precursory phenomenon of dielectric breakdown occurs. The streamer may develop not only in the axial direction 110 but also in a horizontal axis direction along the coil surface toward the pressboard insulation cylinder. The streamer may also develop to the surface of the pressboard insulation cylinder, and dielectric breakdown may occur between the HV winding and the LV winding.

The L-shaped insulation barriers 5*a* and 5*b* are provided for preventing the streamer from developing to the surface of the pressboard insulation cylinder. A horizontal portion of the L-shaped insulation barrier 5*a* is provided between the disc coils 3*b* and 3*c* so as to closely contact the lower surface of the disc coil 3*b* in the same manner as Embodiment 1. A tip end portion 8*a* in the axial direction 110 of the L-shape insulation barrier 5*a* is provided so as to closely contact an inner surface of the disc coil 3*b* which is adjacent to the pressboard insulation cylinder 7. The flow path for the cooling medium is formed between the disc coils 3*a* and 3*b*, therefore, a height of the vertical tip end portion 8*a* is lower than a thickness of one coil so as not to interfere with the flow of the cooling medium.

The L-shaped insulation barrier 5*b* is provided so as to closely contact the disc coil 3*c* in the same manner.

According to the structure of the embodiment, the development of the streamer due to the high voltage generated between shield wires can be stopped by the tip end portions 8*a* and 8*b* in the axial direction 110 of the L-shaped barriers 5*a* and 5*b* and does not reach the surface of the pressboard insulation cylinder 7. It is possible to prevent dielectric breakdown between the HV winding and the LV winding.

As the L-shaped insulation barriers 5*a* and 5*b* are non-conductors of heat, diffusion of heat generated from the lower surface of the disc coil 3*b* and the upper surface of the disc coil 3*c* is not efficient when installing the L-shape insulation barriers 5*a* and 5*b*. Accordingly, a distance $d_2$ between the disc coils 3*a* and 3*b* is provided to be larger than a distance $d_1$. That is, $d_2>d_1$. $d_1$ denotes a distance between the disc coils 3*b* and 3*c*. A value of $d_2$ is preferably set to a distance necessary for allowing a temperature at a hot spot of the winding to be equal to or less than international/domestic standard values when the stationary induction electrical apparatus is operated in this structure.

In addition to the method for securing cooling, for example, a method of increasing a flow rate of the cooling medium by performing setting so that $d_2=d_1$ can be considered.

In the case where a press board with 1.6 mm in thickness is used as the L-shaped insulation barriers 5*a* and 5*b*, the breakdown voltage is improved approximately 40%.

Here, the invention is not limited to the structure in which the flow path is provided between coils of odd-ordinal layers and the L-shaped insulation barrier is provided between coils of even-ordinal layers, and it is also preferable to adopt a structure in which the L-shaped insulation barrier is provided between disc coils where the high voltage is generated between the shield wires to secure the cooling flow path between coils where the low voltage is generated between the shield wires when the high voltage and the low voltage are alternately generated.

According to the structure of the embodiment, a withstand voltage between high-voltage coils of the disc winding can be improved by adopting the L-shaped insulation barrier without complicating manufacturing processes.

Embodiment 2

Figure 4:
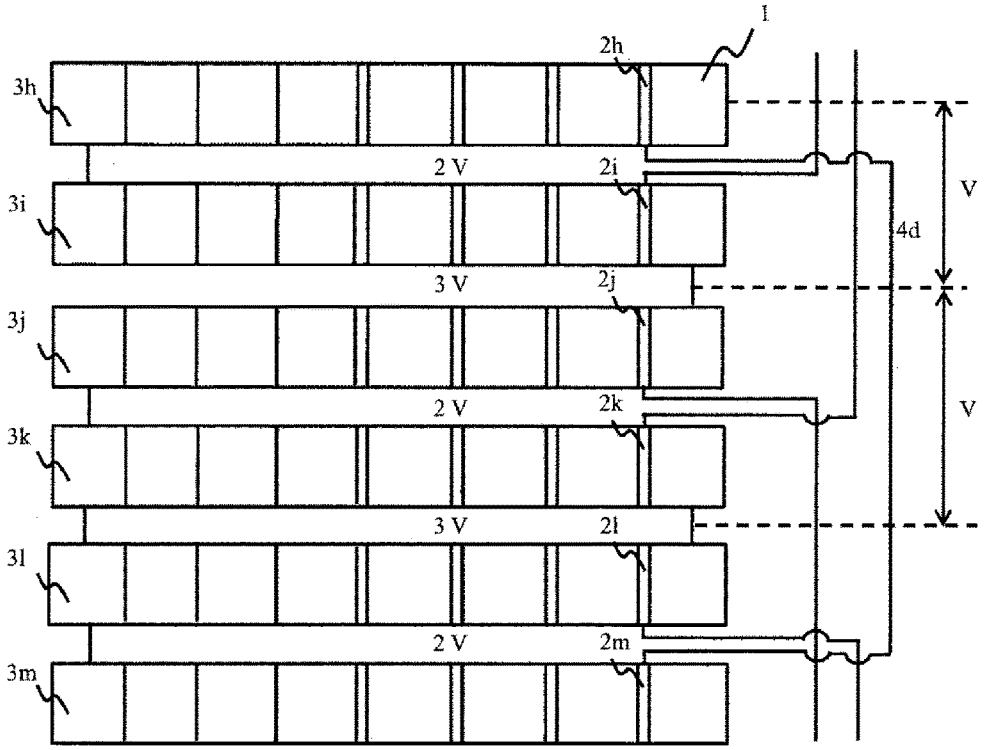
FIG. 4 is a vertical cross-sectional view showing a disc winding connection of a stationary induction electrical apparatus according to Embodiment 2 of the invention.
Figure 4:
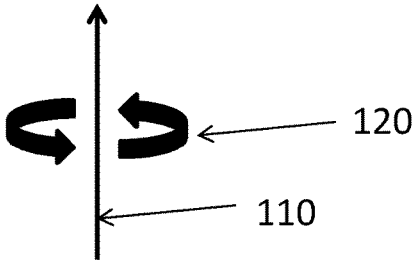

FIG. 4 shows a vertical cross-sectional view of a disc winding connection diagram of a stationary induction electrical apparatus according to Embodiment 2 of the invention. In the embodiment, the same symbols are added to the same components as those of Embodiment 1 and the explanation thereof is omitted. Only different components will be explained. As the electric wire 1, the shield wires 2*h*, 2*i*, 2*j* . . . , the disc coils 3*h*, 3*i*, 3*j* . . . are the same as those of Embodiment 1, the explanation thereof is omitted.

A winding having a structure in which the disc coil 3*h* in which the electric wire 1 is wound in a circumferential direction 120 with 8 turns and the shield wire 2*h* is wound with 4 turns on the outer peripheral side thereof and plural disc coils 3*i*, 3*j* . . . having the same structure are stacked in the axial direction 110. The shield wire 2*h* is connected to a shield wire 2*m* wound in a disc coil 3*m* of the sixth layer counted from the disc coil 3*h* by a crossover line 4*d* for shielding.

It is known that good insulation characteristics when the lightning surge occurred and so on can be obtained in the structure in the same manner as Embodiment 1.

On the other hand, a voltage 2V and a voltage 3V are alternately generated between the shield wires 2*h* and 2*i* wound in the disc coils 3*h* and 3*i* and between the shield wires 2*i* and 2*j* wound in the disc coils 3*i* and 3*j* in the structure.

The L-shaped insulation barrier is provided between coils in which a voltage between shield wires is 3V in the same manner as Embodiment 1. Also, a distance between coils in which a voltage between shield wires is 2V is increased to secure the cooling performance.

The invention is not limited to the above embodiments and various modification examples are included. In above embodiments, the invention is explained clearly, and the embodiments are not always limited to ones including all components explained above. It is possible to replace part of components of one embodiment with components of another embodiment, and it is also possible to add components of one embodiment to components of another embodiment. Furthermore, addition, deletion and displacement of part of components of each embodiment may be performed with respect to components of another embodiment.

What is claimed is:

1. A stationary induction electrical apparatus including a disc winding in which plural disc coils provided with a plurality of electric wires wound in a helical manner on the same plane in a circumferential direction are stacked in an axial direction of a pressboard insulation cylinder, coils in which an inter-coil spacer is arranged between the disc coils are provided, a shield wire of a certain-ordinal layer in the axial direction and shield wires of a fourth, sixth layers counted from the shield wire among shield wires wound with plural turns between wires of respective disc coils are connected by a crossover line for shielding, and a high voltage and a low voltage are alternately generated between adjacent shield wires arranged in the axial direction, the apparatus comprising:

a flow path for a cooling medium provided between coils where a low voltage is generated between shield wires; and an L-shaped insulation barrier provided between coils where a high voltage is generated between the shield wires, wherein a horizontal portion of the L-shaped insulation barrier is provided so as to closely contact an upper surface or a lower surface of the disc coil, a tip end portion in the axial direction of the L-shaped insulation barrier is provided so as to closely contact an inner surface of the disc coil which is adjacent to the pressboard insulation cylinder, and a height of the tip end portion in the axial direction is lower than a thickness of one coil.

* * * * *